US005634691A

United States Patent [19]

Kim et al.

[11] Patent Number: 5,634,691

[45] Date of Patent: Jun. 3, 1997

[54] METHOD FOR EXCAVATING A WORKING FACE BY BLASTING

[75] Inventors: Myongkyu Kim; Yeongjae Yoon, both of Seoul, Rep. of Korea

[73] Assignee: Sungkyong Engineering & Construction Limited, Rep. of Korea

[21] Appl. No.: 678,169

[22] Filed: Jul. 11, 1996

Related U.S. Application Data

[63] Continuation of Ser. No. 342,262, Nov. 18, 1994, abandoned.

[30] Foreign Application Priority Data

Jul. 13, 1994 [KR] Rep. of Korea ..... 94-16874

[51] Int. Cl.$^6$ ..... F42D 3/04

[52] U.S. Cl. ..... 299/13; 102/312

[58] Field of Search ..... 299/13; 175/2; 102/311, 312

[56] References Cited

U.S. PATENT DOCUMENTS 4,175,490 11/1979 Britton et al. ..... 102/312

FOREIGN PATENT DOCUMENTS 296246 4/1916 Germany ..... 299/13

119519 10/1918 United Kingdom ..... 299/13

OTHER PUBLICATIONS

*Mining Engineering*, "Open Pit and Underground Blasting Techniques", Aug. 1981, pp. 1215–1219.

*Blaster's Handbook*, 15th Edition, Dupont Canada Inc. 1969 pp. 245–279.

*Primary Examiner*—David J. Bagnell

*Attorney, Agent, or Firm*—Merchant, Gould, Smith, Edell, Welter & Schmidt

[57] ABSTRACT

The present invention relates to a method for forming a parallel bore hole and a slant bore hole (or V-shaped V bore hole) together within the same area of a working face, and then blasting the working face by using a delay electric detonator. The method of this invention includes the steps of drilling a number of V holes at a predetermined angle in a horizontal angle cut pattern or in a vertical angle cut pattern about the central zone of a working face, drilling a number of parallel cut hole within a projective area of the above mentioned slant holes; loading an electric detonator in the slant holes and an explosive material by indirect priming in the parallel cut holes up to the bottom of the slant holes; blasting the slant holes to form a slant free surface; blasting a center cut hole out of the parallel cut holes to form two free surfaces having a funnel shape; and sequentially blasting a middle cut hole and an outer cut hole out of the parallel cut holes to form a cubical space.

13 Claims, 17 Drawing Sheets

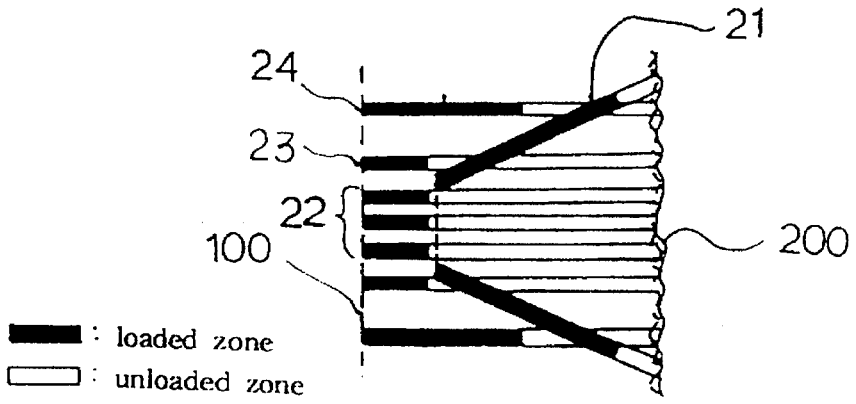
FIG. 11
FIG. 12A
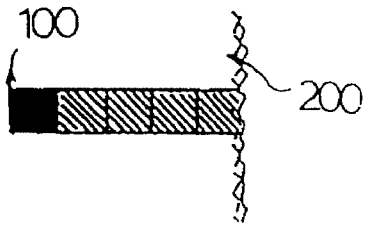
FIG. 12B
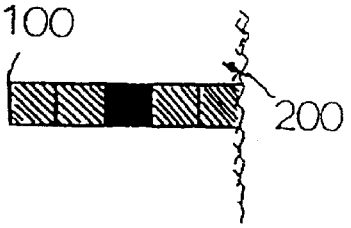
FIG. 12C
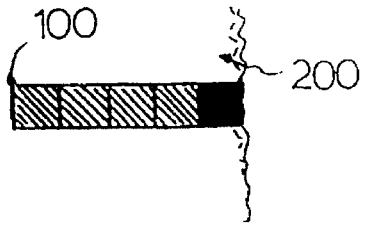
primer
ordinary explosives

METHOD FOR EXCAVATING A WORKING FACE BY BLASTING

This is a continuation of application Ser. No. 08/342,262, filed Nov. 18, 1994, now abandoned.

BACKGROUND OF THE INVENTION

1. Field of the Invention

The present invention relates to an aggregate blasting method for the excavation of a working face having one free surface in tunnel and particularly to a method of forming a second free surface comprised of these steps: drilling a number of slant holes around the central zone of a working face and a number of parallel cut holes with an area surrounded by the holes in a working face; loading an electric detonator and an explosive material in the holes and the parallel cut holes; and sequentially blasting the holes and center cut holes, middle cut holes and outer cut holes out of the parallel cut holes in order to form a cubical space, whereby a second free surface is easily formed.

2. Description of the Prior Art

Generally, with a blasting method for excavating the working face having one free surface, a method for drilling cut holes in order to obtain a second free surface is divided into an angle cut method and a parallel cut method according to a drilling method of cut holes.

The V-cut method in angle drilling and the burn cut method in parallel drilling are now generally used in a tunnel blasting.

The angle cut method is applied to the short hole blasting of soft rock and the burn cut method is applied to the long hole blasting of hard rock.

However, the burn cut method as shown in FIGS. 1A–1B has many problems as follows:

1) In order to increase the blasting efficiency based on a theory of blasting, the projective area of a pilot hole against a free surface must be large. But, the projective area of the parallel hole is small as shown in FIG. 5B, and the blasting efficiency is low because a blasting pressure acts on 40°~60° against the working face 9 as shown in FIG. 17B.
2) The relief hole 1 in FIG. 1A–1B is difficult to drill and the drilling must be done so that the spacing of relief holes 1 may be 5 cm to 7 cm. Accordingly, a high level of drilling technology and expensive drilling machines are required. Also, the interpenetration of relief holes may frequently occur.
3) Because relief hole 1 has a large diameter, its drillng time is long.
4) A rock is difficult to reinforce because rock damaged zone 6 is large, and a scaling time of fragmented rocks is long.
5) A ventilation pipe, an electric panel, and a drill's water pipe are damaged because the fragmented rocks badly scatter.
6) A number of the pilot holes must be formed because the projective area of the pilot hole is small. Also, since the explosive material must be tightly loaded, a large quantity of explosive material is required.
7) The working time per excavation cycle is long. The cost of reinforcement and excavation is high because the excavation efficiency is low.

Also, the angle cut method as shown in FIG. 2A–2B has many of the following problems:

1) The advance of the V hole is shorter than that of the parallel hole. So, the blasting efficiency is the lowest in the case of a long hole.
2) A spacing of V holes on the hole bottom section must be about 100 mm. If the spacing of slant holes on the hole bottom section is more 100 mm, the blasting efficiency decreases. If the spacing on the hole bottom section is less 100 mm, the V holes might be interperforated.
3) Because the holes are drilled with a dip, the hole bottom section and the drilling depth are not uniform. Thus, the rock damaged zone is large and the blasting pressure is large. Also, the possibility of an accident because of the fragmented rock is increased, and it takes long time to scale the fragmented rock.
4) A number of the cut spreader holes 12 (see FIG. 2B) must be drilled to tightly load the explosive material in the center of the working face.
5) The cost of reinforcement and excavation is high because the excavation efficiency is low.

Consequently, so far, the previous angle cut technique mainly depends on the procedure of increasing a projective area of the V hole in order to increase a blasting efficiency by the formation of a second free surface. However, the spacing of the V holes on the hole bottom section must be about 100 mm and the loading density of the explosive material must be large.

To obtain two free surfaces, the blasting method by the parallel cut must include the steps of drilling the relief hole 1, the hole diameter of which is $\phi$102~120 mm, and the cut holes 2, the spacing of which is 5~7 cm, loading the explosive material in the cut holes 2, and blasting the cut holes 2. Alternatively, to form a second free surface, an unloaded hole having a large diameter is drilled by a tunnel boring machine.

Accordingly, the previous conventional techniques require a high level of technology and machinery.

OBJECTS OF THE INVENTION

The primary object of this invention is to provide a blasting method for tunneling a working face having one free surface, which comprises steps of drilling a number of V holes around the central zone of a working face and a number of parallel cut holes within an area surrounded by said V holes in a working face; loading an electric detonator and an explosive material in the V holes and the parallel cut holes; and sequentially blasting the V holes and center cut holes, middle cut holes and outer cut holes out of the parallel cut holes in order to form a cubical space, thereby easily forming a second free surface.

A further object of the present invention is to provide a blasting method for tunneling a working face having one free surface, that is capable of remarkably reducing the damage zone of the working face.

Another object of this invention is to obtain a high blasting efficiency without sophisticated machinery and highly skilled technicans.

SUMMARY OF THE INVENTION

A method for tunneling a working face of the invention is defined by the claims with a specific embodiment shown in the attached drawings.

The invention relates to a method for tunneling a working face comprising the steps of drilling a number of V holes at a predetermined angle either in the parallel angle cut or in the vertical angle cut pattern around the center of a working face; drilling a number of parallel cut holes within a projective area of said holes; loading an electric detonator in the V holes and an explosive material by indirect priming in the parallel cut hole up to the bottom of the V holes; and blasting the V holes in order to form a slant free surface; and blasting a center cut hole out of the parallel cut holes to form two free surfaces having a tunnel shape; sequentially blasting a center cut spreader hole and an outer cut hole out of the parallel cut holes to form a cubical space.

BRIEF DESCRIPTION OF THE DRAWINGS

To understand the nature and objects of the invention, refer to the following detailed descriptions taken in conjunction with the accompanying drawings.

FIG. 11 illustrates a fragmentary cross-sectional area representing a loading pattern of the explosive material in cut holes.

FIGS. 12A–C illustrate descriptive views representing loading positions of a primer.

DETAILED DESCRIPTION OF THE INVENTION

Before explaining the present invention in detail, it is to be understood that the invention is not limited in its application to the details illustrated in the accompanying drawings, since the invention is capable of other embodiments and of being practiced or carried out in various ways. Also, it is to be understood that the phraseology or terminology employed herein is for the purpose of description and not of limitation.

Figure 1A:
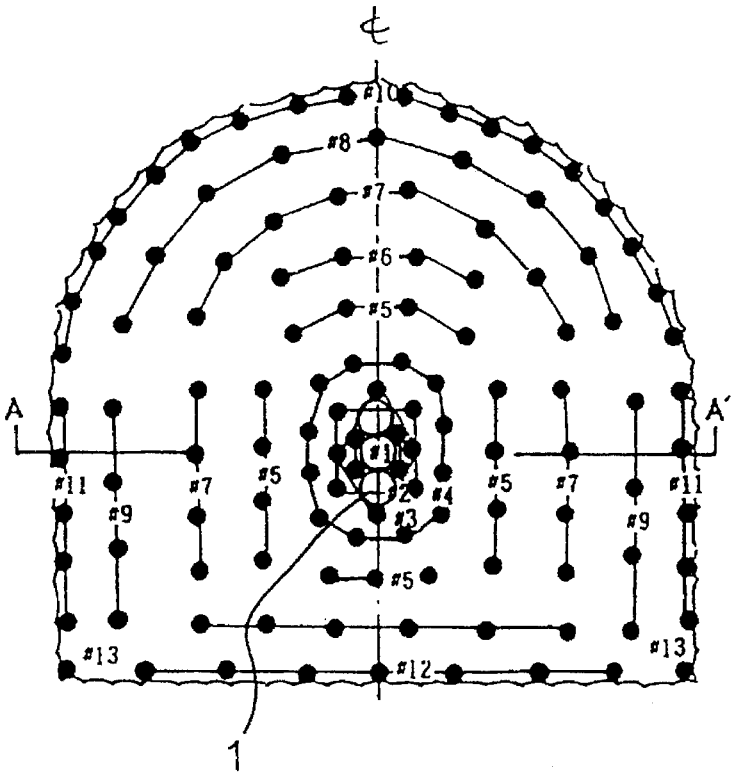
FIG. 1A PRIOR ART
FIG. 1A illustrates a front view of a working face showing a drilling pattern in a burn cut method.
Figure 1B:
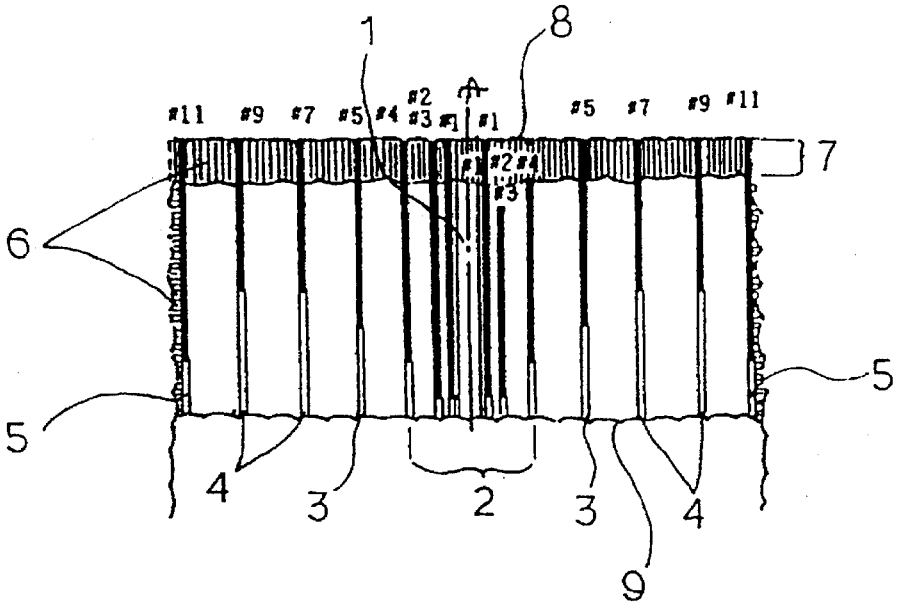
FIG. 1B PRIOR ART
FIG. 1B illustrates a cross-sectional view taken along the A–A' line in FIG. 1A.
Figure 2A:
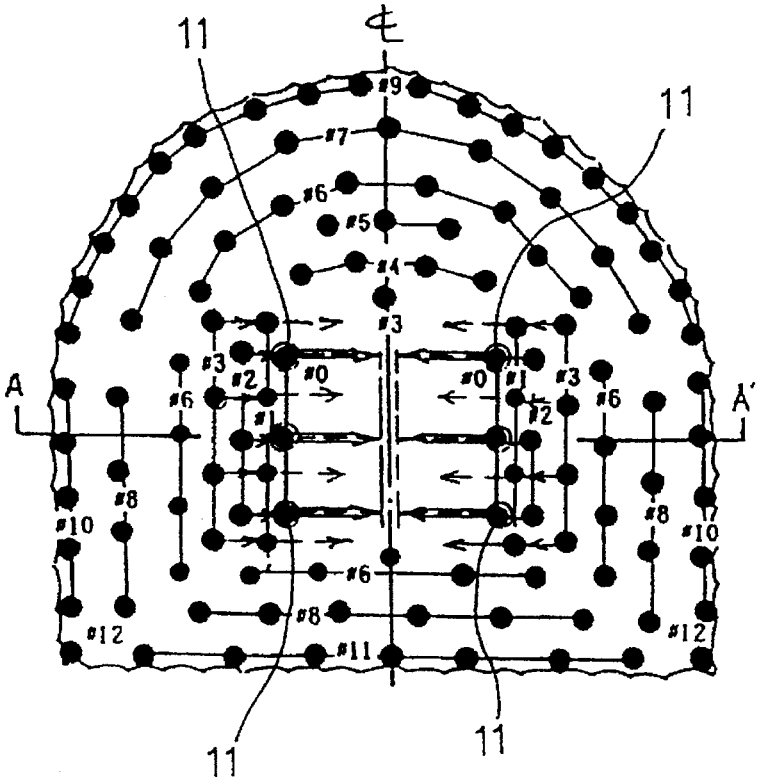
FIG. 2A PRIOR ART
FIG. 2A illustrates a front view of a working face showing a drilling pattern in an angle cut method.
Figure 2B:
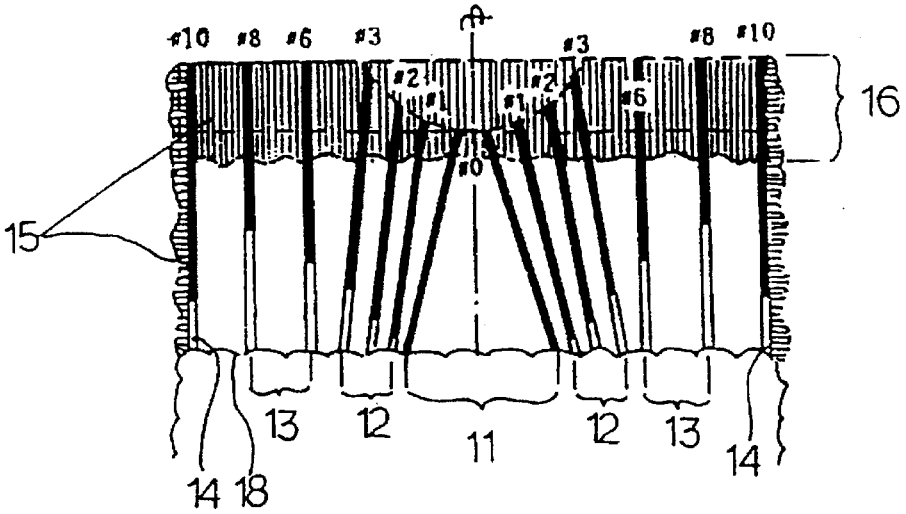
FIG. 2B PRIOR ART
FIG. 2B illustrates a cross-sectional view taken along the A–A' line in FIG. 2A.
Figure 3A:
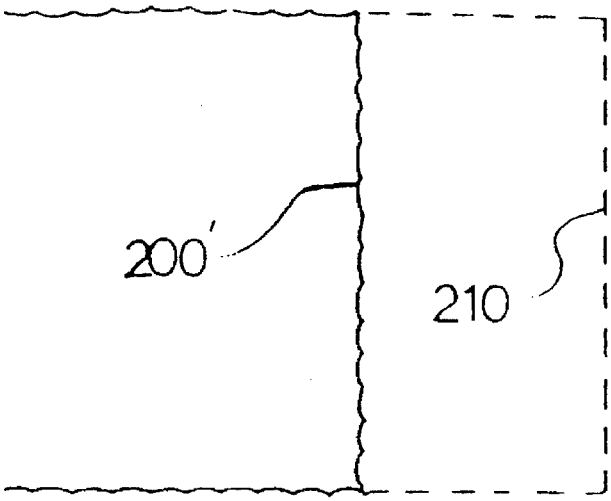
FIGS. 3A, 3A', 3B, 3B', 3C, 3C' illustrate the blasting process in accordance with the embodiment of the invention.
Figure 3A:
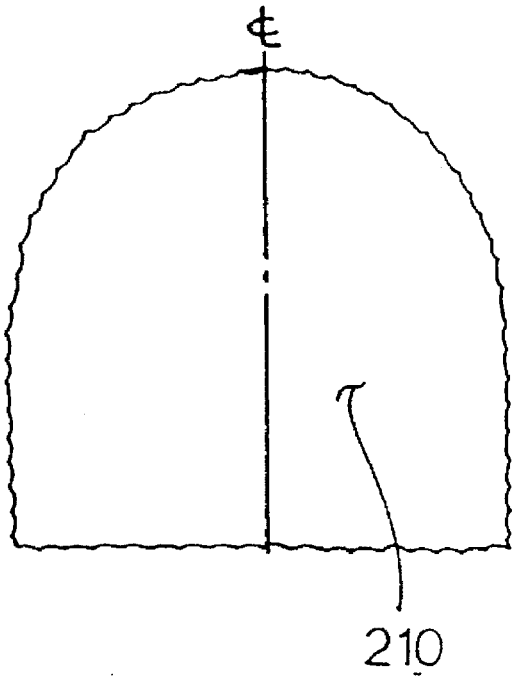
Figure 3B:
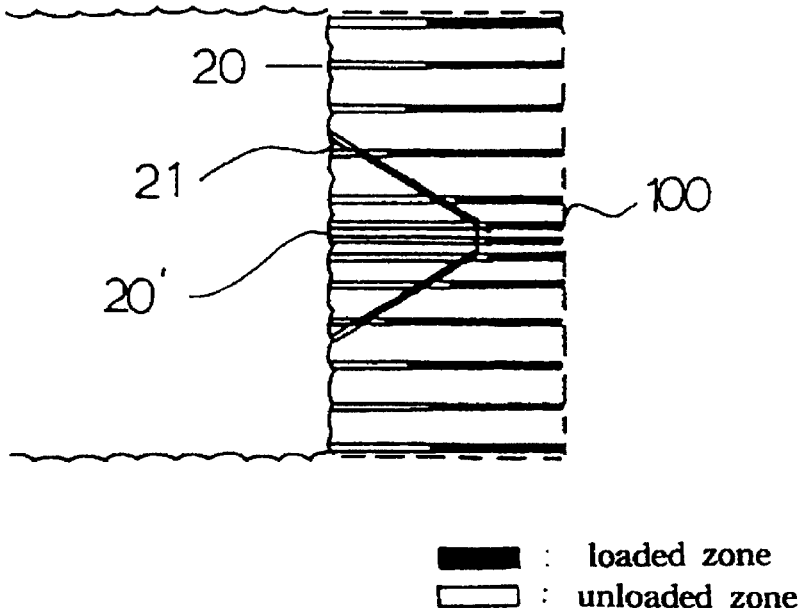
Figure 3B:
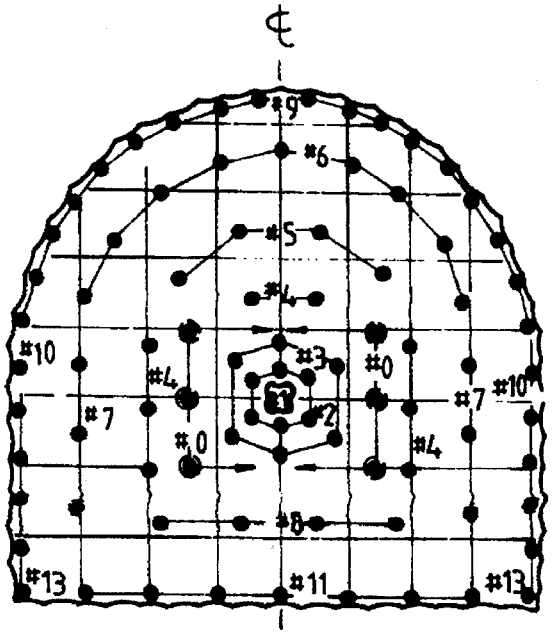
Figure 3C:
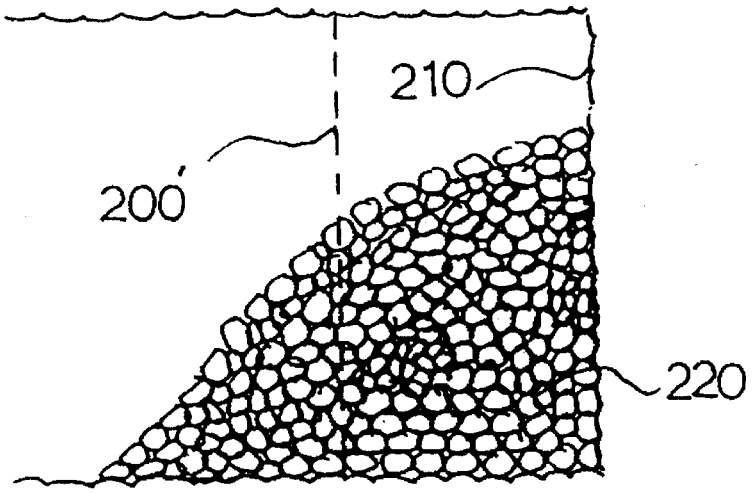
Figure 3C:
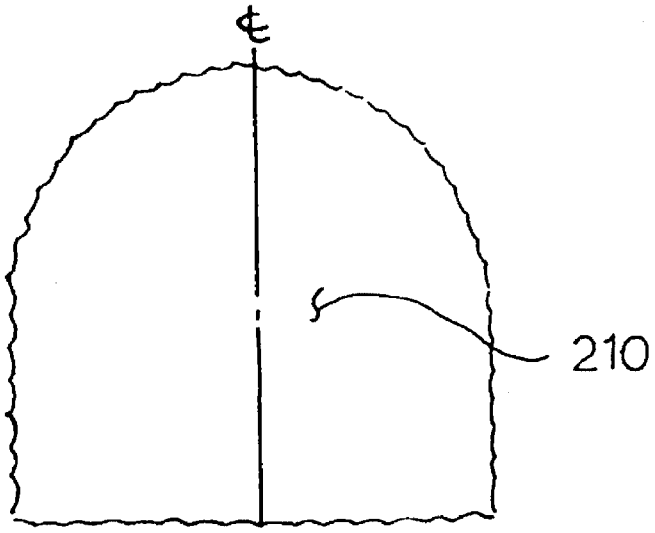
Figure 16A:
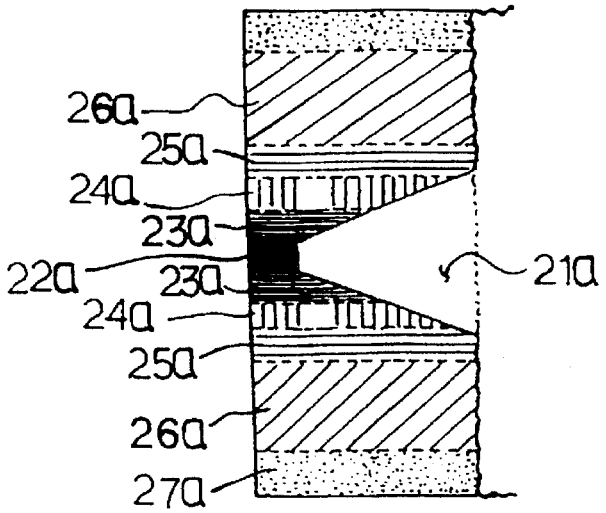
FIG. 16A–G illustrate a descriptive views representing a tunneling process of a working face in accordance with the embodiment of the invention.
Figure 16B:
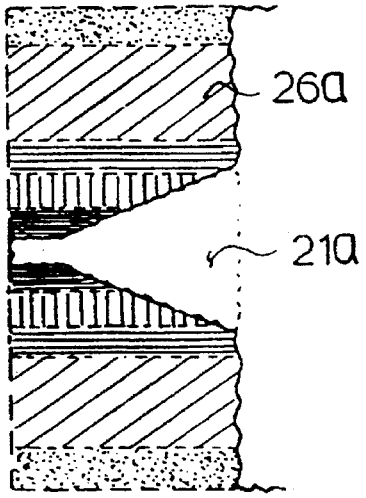
Figure 16C:
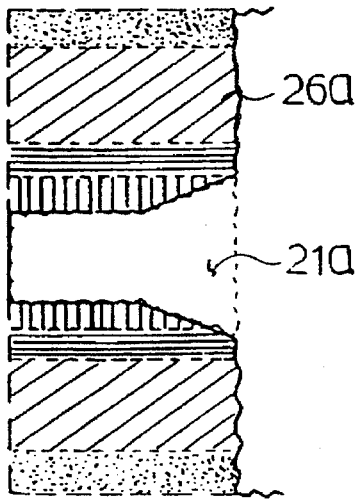
Figure 16D:
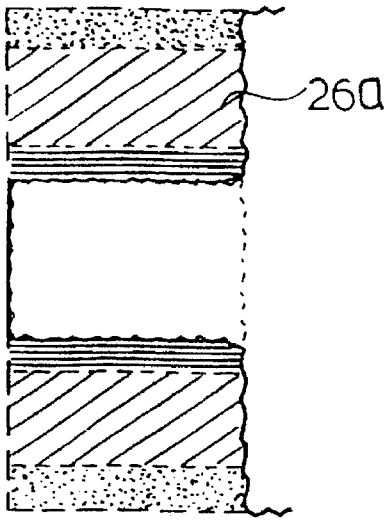

Referring to FIG. 3A, in order to excavate a working face having one free surface at the 200' line up to a predetermined tunneling line 210, a number of vertical V-holes 21 are drilled at a predetermined angle on a specific area of a working face according to the conditions of excavation such as rock strength, tunnel shape, and explosive materials used. Thereafter, a number of parallel cut holes 20' are drilled within an area surrounded by said V holes 21 in a working face wherein the bottom line of the parallel cut holes extends beyond the bottom line of the V-hole as shown in FIG. 11. The parallel cut holes 20' consist of a number of center cut holes in area 22*a*, middle cut holes in area 23*a* and outer cut holes in area 24*a*, as shown in FIG. 3B and FIG. 16A.

Also, a number of parallel holes 20 are drilled within the circumferential zone of said cut holes 20' and 21 as shown in FIG. 3. The parallel holes 20 consist of a number of center spreader holes in area 25*a*, stopping holes in area 26*a* and contour holes in area 27*a*, as shown in FIG. 16A.

An electric detonator is loaded into the V holes 21 and the parallel holes 20 and 20'.

The explosive material in said parallel cut holes 20' is loaded from the bottom line of said parallel cut holes up to the bottom line of the V holes by indirect priming.

The bore holes are blasted in an initiation sequence according to the numerals indicated in FIG. 3B', and then fragmented rocks are scaled, so that a cycle of excavating a working face is accomplished up to the predetermined tunneling line 210.

Figure 9A:
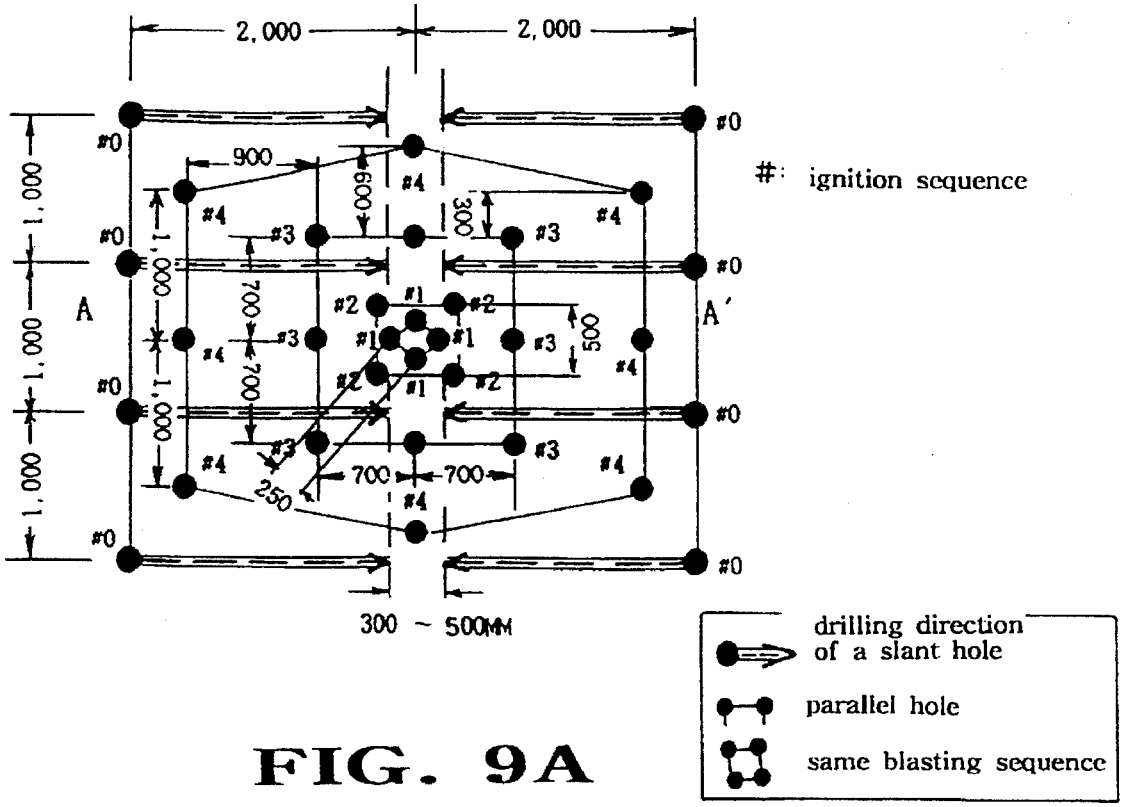
FIGS. 9A to 9E illustrate schematic views representing drilling spacings and positions of cut holes in a great working face, a great-middle working face, a middle-small working face, a first small working face, and a second small working face.
Figure 9B:
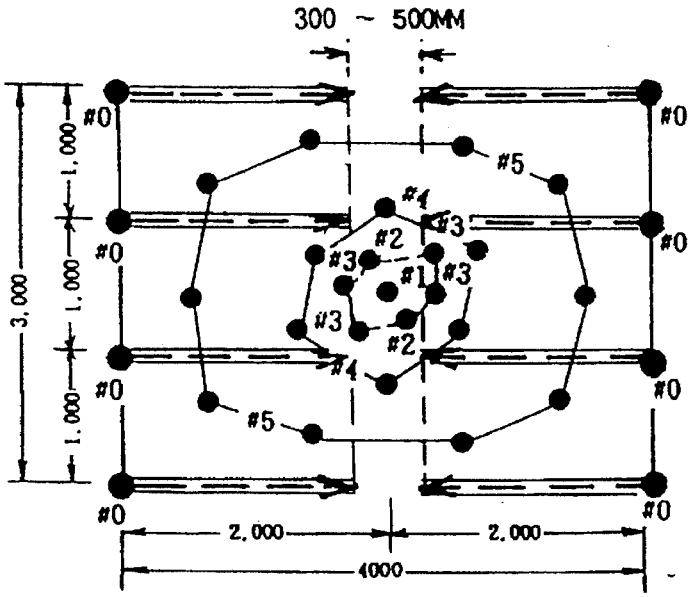
Figure 9C:
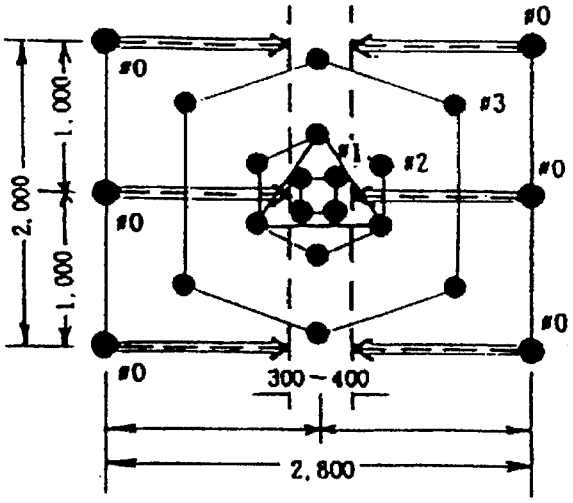
Figure 9D:
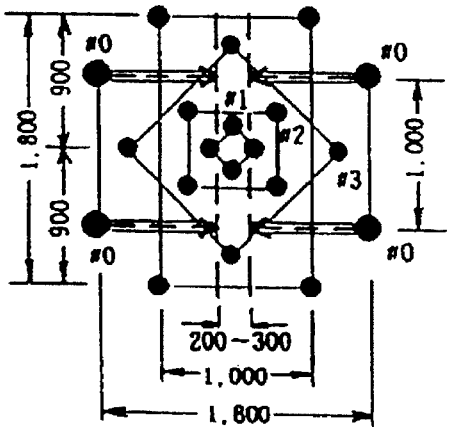
Figure 9E:
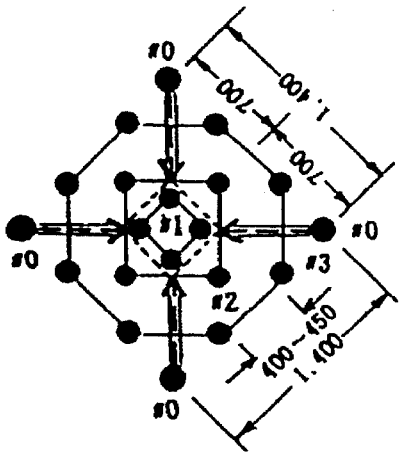

Now referring to the drawings for the purpose of illustrating the present invention FIGS. 9A, B, C and D show the spacings and positions of the parallel cut holes in a great working face, a great-middle working face, a middle-small working face, and a small working face, respectively. FIG. 9E is an alternate example showing the spacing and positions of the parallel cut holes in a small working face. A proper number of vertical V-holes 21, as shown in FIGS. 9A to 9D are drilled at a predetermined angle on a specific area of the working face depending on excavation conditions. Though not shown in the drawings, a number of horizontal V-holes can be drilled at a predetermined angle on a specific area of the working face depending on excavation conditions. Furthermore, as shown in FIG. 9E, the V-holes can be drilled in a diamond so that the V-holes are aimed toward the center of the small working face.

Figure 4:
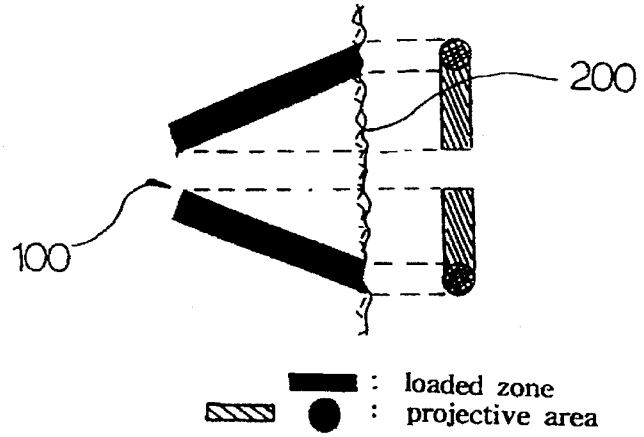
FIG. 4 illustrates a descriptive view representing the projective area of a V borehole.
Figure 5:
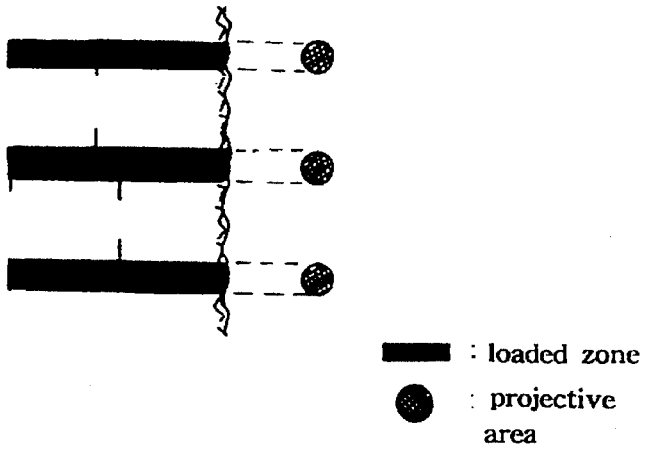
FIG. 5 illustrates a descriptive view representing the projective area of a parallel borehole.
Figure 6:
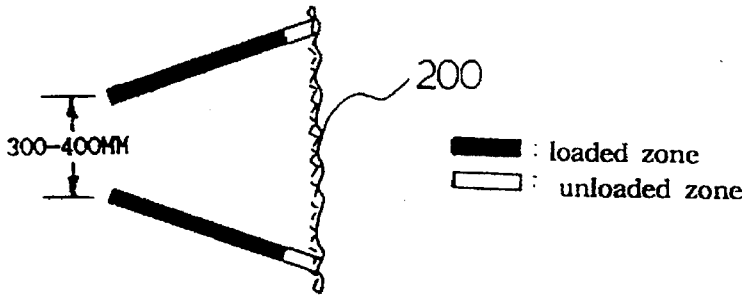
FIG. 6 illustrates a fragmentary cross-sectional view of a V borehole in accordance with the embodiment of the invention.
Figure 7:
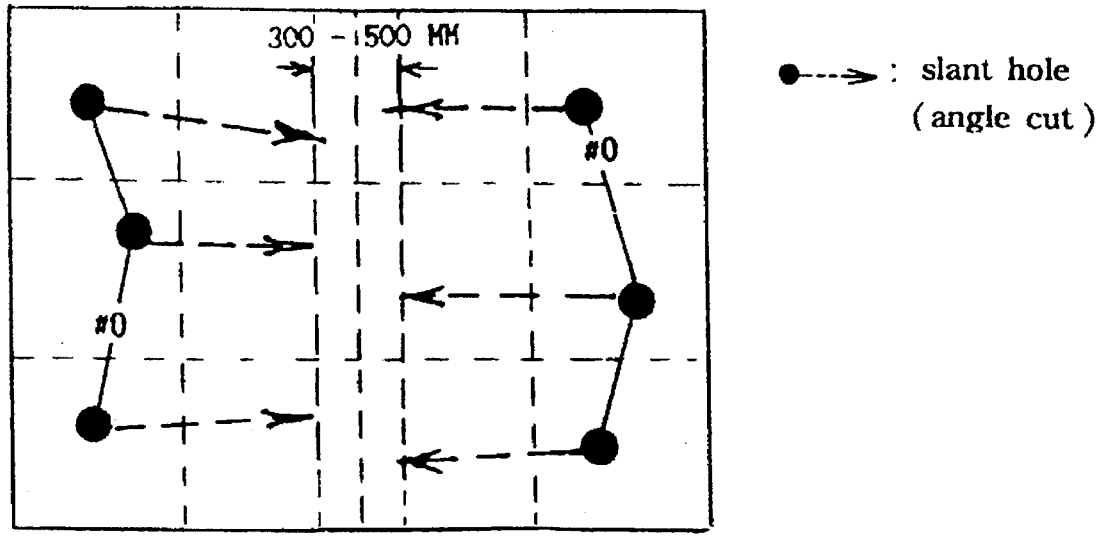
FIG. 7 illustrates a descriptive view representing the position and a spacing of V boreholes in accordance with the embodiment of the invention.
Figure 8:
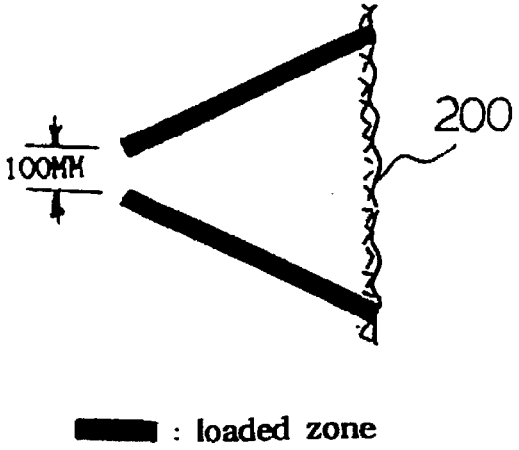
FIG. 8 illustrates a fragmentary cross-sectional view of a slant borehole in accordance with the previous method.

Since the blasting efficiency increases in proportion to the projective area according to the theory of blasting, the projective area of the V holes must be enlarged to increase the blasting efficiency. In the above descriptions, a projective area is defined as an area which a hole projects on a working face. As shown in FIGS. 4 and 5, as the V hole's angle increases, a projective area increases. A projective area of a parallel hole equals its sectional area.

With the present invention, the spacing and angle of V holes are determined by excavation conditions. For example, the spacing at the bottom between the two holes that compose each V-hole is approximately 30–50 cm. as shown in FIGS. 9A, B, C, D and E. Although the drilling angle of the V holes or the position of the bottom end and top end thereof varies with the V holes, the blasting efficiency does not decrease because the rocks beneath the bottom of the V holes are easily blasted by the explosive material of the lower part of the center cut holes in area 22*a*, as shown in FIGS. 15B to 15D and FIGS. 16A to 16G.

However, with previous conventional techniques, the blasting efficiency decreases when the two holes that compose each V-hole are interpenetrated or the spacing between the bottom of the two holes that compose each V-hole is increased. To avoid this problem, the V-holes must be precisely drilled so that the spacing at the bottom between the two holes that compose each V-hole is 10 cm.

That is, in the present invention, the blasting efficiency does not the spacing at the bottom between the two holes that compose each V-hole is approximately 30–50 cm. Accordingly, in the present invention there is no need for spacing at the bottom between the two holes that compose each V-hole to be about 10 cm.

A proper quantity of V holes 21 are drillied around the center of a working face, and then a number of parallel cut holes 20' are drilled within an area surrounded by said V holes 21 on a working face. In the present invention, it is preferable to drill many parallel cut holes 20' around the core of a working face, i.e., center cut holes 22, if possible. The spacing of center cut holes 22 in area 22*a* is preferably 200 mm to 300 mm. The spacings of the parallel cut holes 23 and 24 in areas 23*a* and 24*a* except for said center cut holes 22 in area 22*a* are 100 mm to 500 m, preferably 400 mm to 500 mm (see FIGS. 9A to 9E, 11, and 16A).

Figure 10A:
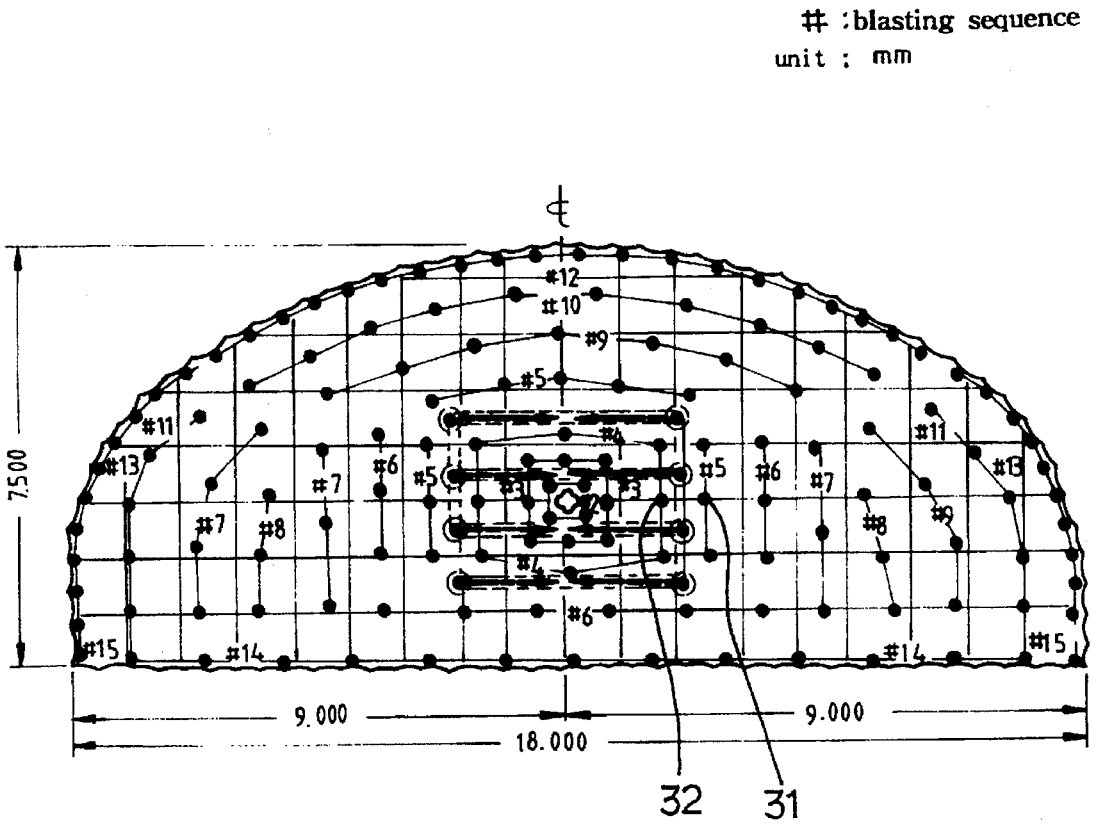
FIG. 10A–C illustrance a schematic view representing a drilling spacing and pattern of boreholes in a great working face, a middle working face, and a small working face.
Figure 10B:
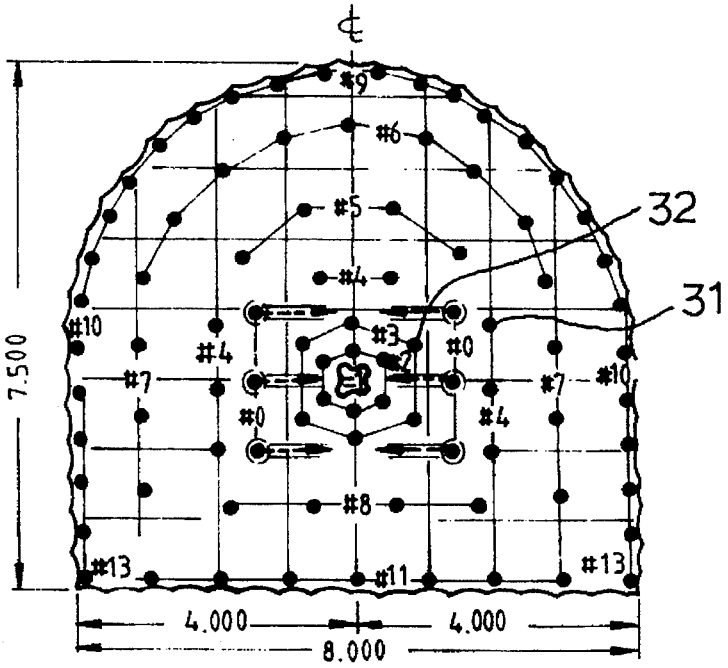
Figure 10C:
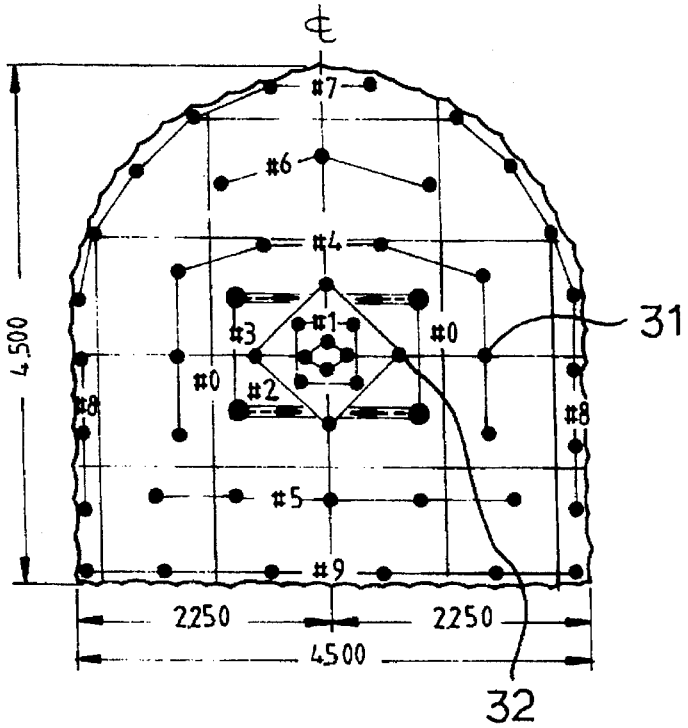

FIGS. 10A, B, and C illustrate schematic views representing drill spacing and patterns of boreholes in a great working face, a middle working face, and a small working face, respectively.

Referring to FIG. 10A, B and C the spacing between parallel holes 20, except said parallel cut holes 20', is determined according to the excavation condition and the spacing between the outer cut hole 32 and a cut spreader hole 31 is preferably 100 mm~500 mm, as shown in FIGS. 10A, B and C.

In loading, as shown in FIG. 11, the degree of loading in V holes 21 is determined by the excavation condition. However in the present invention, the V holes 21 are loaded with the explosive material up to 80% of their length and an instantaneous electric detonator to blast the V holes 21 at the same time. Referring to FIG. 12A to 12C, a booster (or a primer) may be loaded in the V holes 21 by indirect priming or middle priming. In the above descriptions, an electric detonator is a detonator ignited without a time difference at the same time that electric power is supplied. The electric detonator in the V holes 21 may be a delay electric detonator.

Electronic detonator loading types are divided into indirect priming, middle priming, and direct priming according to the position of the primer as shown in FIG. 12A to 12C. Indirect priming loads the primer on the hole bottom section as shown in FIG. 12A, middle priming loads the primer between the bottom of the hole and the entrance of the hole of the working face as shown in FIG. 12B, and direct priming loads the primer around the hole entrance of the working face as shown in FIG. 12C.

Figure 13:
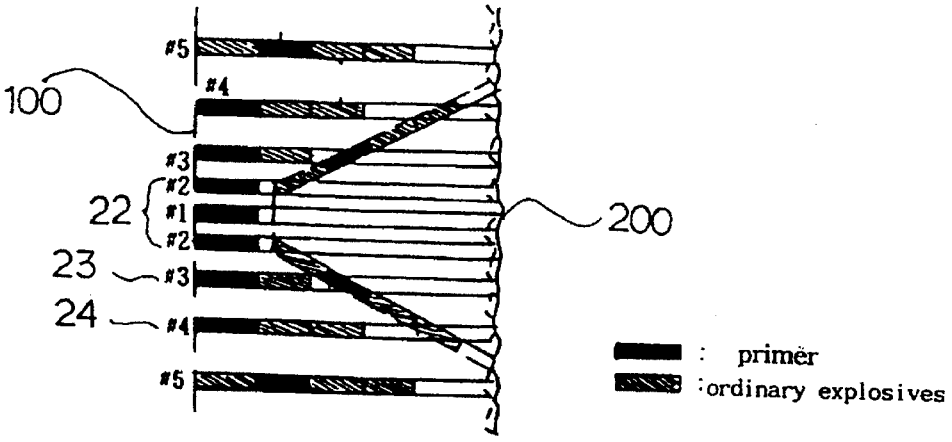
FIG. 13 illustrates a fragmentary cross-sectional area representing a loading position of a primer in cut holes.

As shown in FIG. 13, the center cut holes 22, those innermost parallel cut holes which lie between the endpoints of the V-holes are loaded with the explosive material only from the bottom line of said cut holes 22 up to the bottom line of the V holes 21 and are loaded with the delay detonator using indirect priming. The detonator is probably a MS(millisecond) delay electric detonator which has the shortest explosion time from ignition to the blasting to use the blasting pressure immediately after the blasting of V holes 21, thereby easily blasting the other parallel cut holes except said center cut holes 22.

The middle cut holes 23 and the outer cut holes 24 are also loaded with delay electric detonators through indirect priming only from the bottom line of holes 23 and 24 up to the boundary formed by V holes 21. The fore mentioned delay electric detonators range in type from those featuring short explosion times to those possessing long explosion times as the distance extends from the parallel center cut holes outwardly.

As shown in FIG. 16A, the cut spreader holes in area 28*a*, the stoping holes in area 26*a* and the contour holes in area 27*a* are preferably loaded with DS(decisecond) delay electric detonators. In the above descriptions, the MS delay electric detonators range in sequence from those having short explosion times to those using long explosion times as the distance extends from the core of a working face outwardly. Even in the case where the cut spreader holes in area 25*a*, the stoping holes in area 26*a* and the contour holes in area 27*a* are loaded with MS(millisecond) delay electric detonators, there is not a large change in the blasting efficiency.

Figure 14:
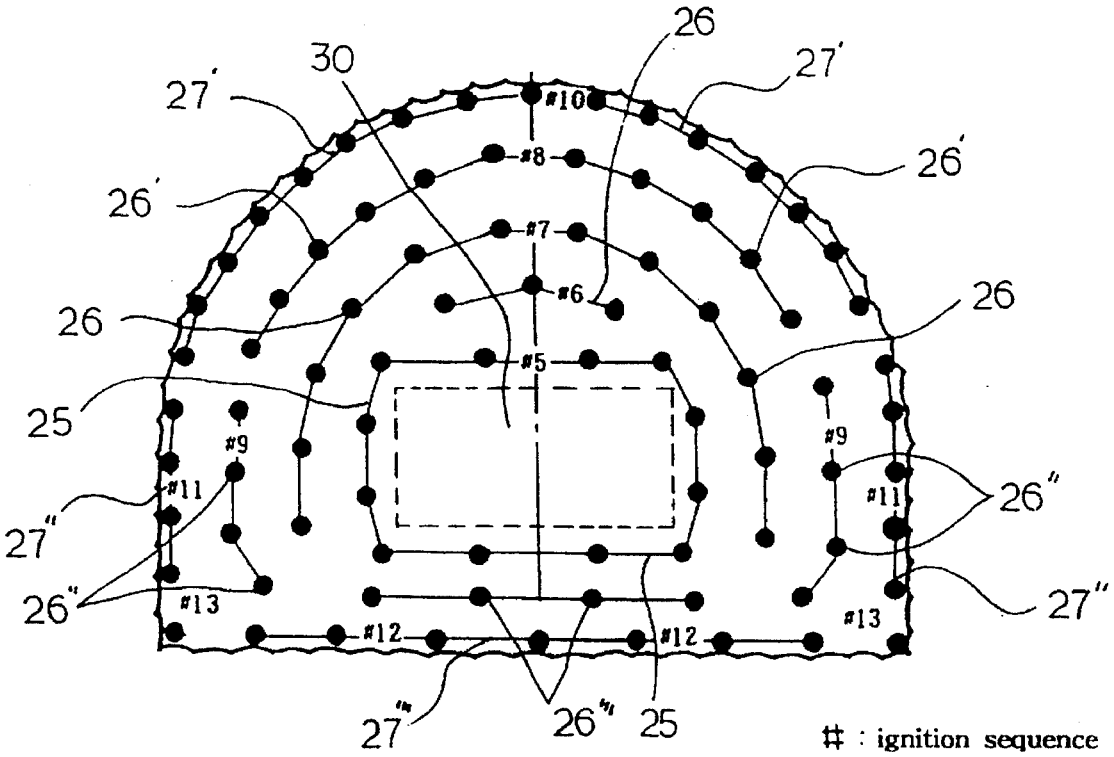
FIG. 14 illustrates a front view representing a blasting sequence of a working face in accordance with the embodiment of the invention.

Referring to FIG. 14, a roof stoping hole 26', a wall stoping hole 26", a floor hole 26'", a roof hole 27', a wall hole 27" and a floor spreader hole 27'" are loaded with a delay electric detonator having a different initiation number, as in previous conventional blasting methods.

Blasting steps of this invention will become apparent from the following detailed description based on FIG. 15A to 15D. First, the V holes 21 are blasted by an instantaneous electric detonator at the same time(see FIG. 15A). The V holes in area 21*a* are easily blasted since unloaded zones of parallel cut holes act as free surfaces.

Figure 15A:
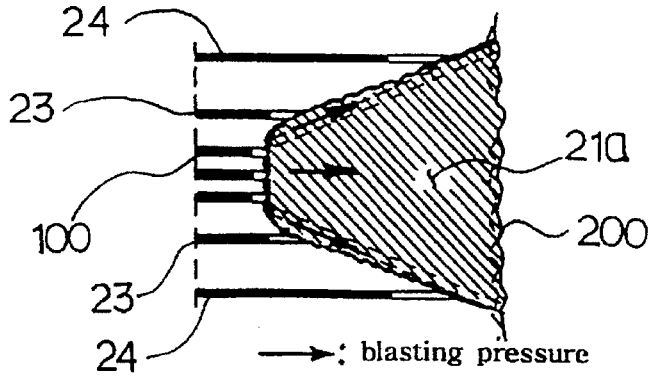
FIG. 15A–D illustrate descriptive views representing a blasting process of cut holes in accordance with the embodiment of the invention.
Figure 15B:
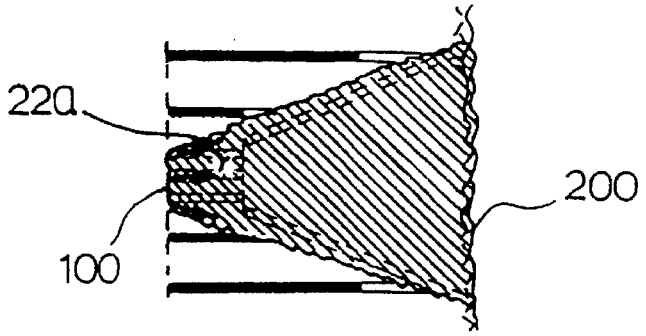

Immediately after V holes in area 21*a* are blasted, the center cut holes in area 22*a* are blasted by a delay electric detonator, preferably a MS detonator to form a second free surface having a funnel or crater shape. So, the parallel center cut holes in area 22*a* are easily blasted by the blasting pressure of the V holes(see FIG. 15B). In the above descriptions, the explosion times (from the ignition to the blasting) of the MS electric detonators loaded in the center cut holes 22 are between 0.01~0.05 seconds. Accordingly, since the center cut holes 22 are blasted by MS electric detonators immediately after the blasting of the V holes 21 with a time difference of milliseconds, the two blasting pressures are multiplied by each other. With this accomplished, even a hole bottom section is efficiently blasted. As a result, a funnel shaped second free surface can be easily obtained as shown in FIG. 15B.

Figure 15C:
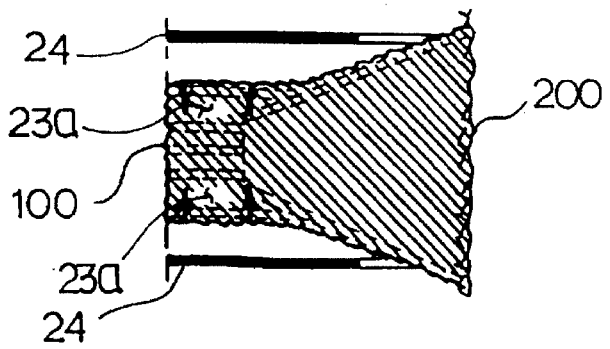

Thereafter, referring to FIG. 15C, the middle cut holes in area 23*a* are sequentially blasted to extend a second free surface.

Figure 15D:
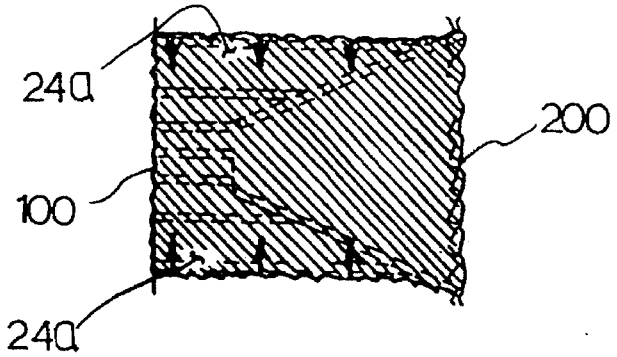

Subsequently, the outer cut holes in area 24*a* are blasted, so that a second free surface of a cubical shape is formed, as shown in FIG. 15D.

FIGS. 15A through D illustrate a descriptive view representing a blasting process of cut holes.

Figure 17A:
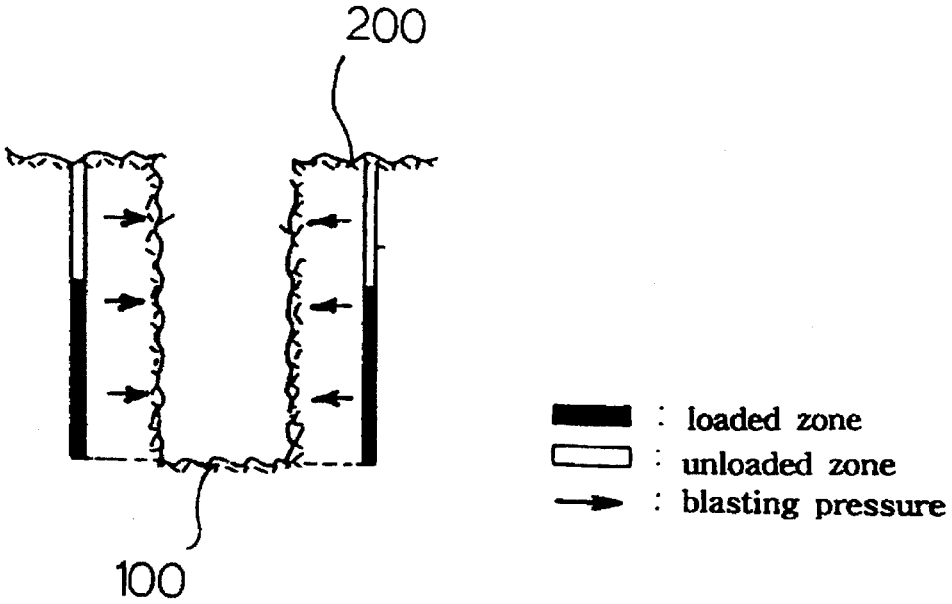
FIG. 17A–B illustrate descriptive views representing a blasting pattern in one free surface and two free surfaces, respectively.
Figure 17B:
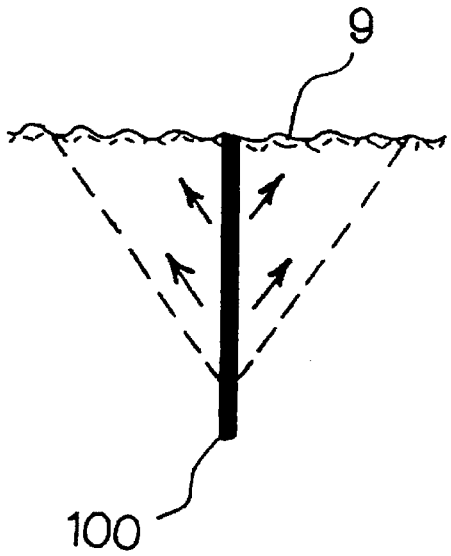

As described above, this invention is characterized in that two free surfaces are, first of all, obtained by blasting cut holes. Once a second free surface of cubical shape is formed around the core of a working face, blasting from the cut spreader holes 25 can be completely achieved by even a small quantity of explosive material since the blasting pressure acts directly on the free surface as shown in FIG. 17A. However, in the case where the blasting is accomplished on one free surface as shown in FIG. 17B, there are the problems that the bore hole may be blasted in the shape of crater, a tight loading of explosives must be made, and the possibility of a blown out shot is high.

Figure 16E:
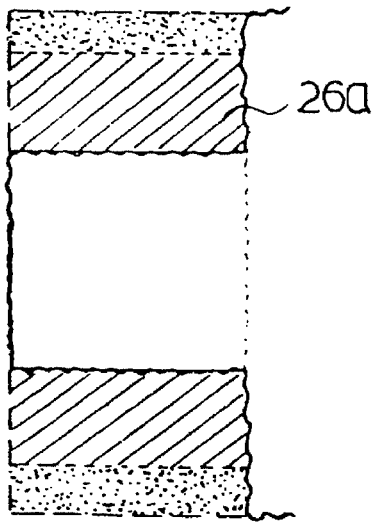
Figure 16F:
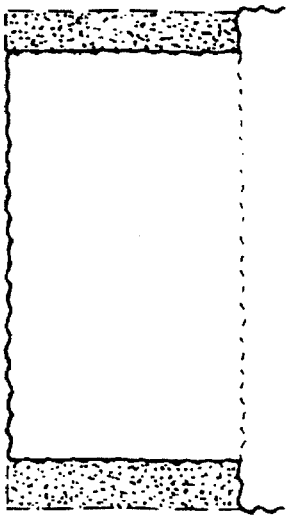
Figure 16G:
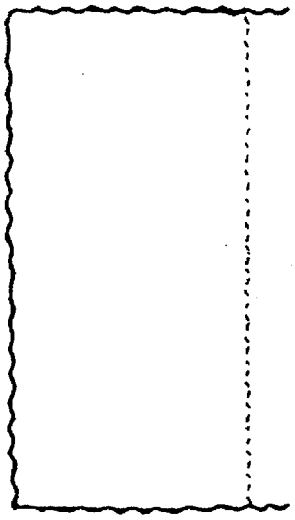

Referring to FIGS. 16E through 16G, the cut spreader holes in area 25*a*, the stoping holes in area 26*a* and the contour holes in area 27*a* are sequentially blasted by a MS electric detonator or a DS electric detonator.

The method for excavating the working face according to an embodiment of the invention has the following benefits in contrast with the previous methods. In the following Tables we have tabulated the results of various tests which we have carried out.

TABLE I

*Full size tunneling shot for large section (14 inch boom used)

| item | | method: present invention ① | burn-cut blasting method ② | V-cut blasting method ③ | comparison ①-② | comparison ①-③ |
|---|---|---|---|---|---|---|
| tunnel standard (m × m) | | 18 × 7.5 | 18 × 7.5 | 18 × 7.5 | | |
| digging sectional area ($m^2$) | | 111.442 | 111.442 | 111.442 | | |
| type of a rock | | hard rock (granite) | hard rock (granite) | hard rock (granite) | | |
| (A) hole depth (m) | | 3.7 | 3.7 | 3.7 | — | — |
| (B) advance (m) | | 3.64 | 3.43 | 3.29 | Δ0.21 | Δ0.35 |
| blasting efficiency (B/A × 100) | | 98 | 93 | 89 | Δ5 | Δ9 |
| drilling time (min.) | | 120.5 | 172.3 | 117.7 | ▼51.8 | Δ2.8 |
| number of holes | unloaded hole | — | 3 | — | ▼3 | — |
| | v hole | 8 | — | 8 | Δ8 | — |
| | others | 148.42 | 155.40 | 126.00 | ▼6.98 | Δ22.42 |
| | total | 156.42 | 158.40 | 134.00 | ▼1.98 | Δ6.7 |
| charge (KG) | | 361.2 | 446.4 | 354.5 | ▼85.2 | Δ22.42 |
| specific explosives quantity ($KG/M^3$) | | 0.89 | 1.17 | 0.97 | ▼0.28 | ▼0.08 |
| flying distance of muck (M) | | 43.0 | 82.85 | 46.6 | ▼39.85 | ▼3.6 |
| scaling time (min.) | | 40.04 | 71.60 | 101.65 | ▼31.56 | ▼61.61 |
| volume of the largest muck ($M^3$) | | 0.34 | 0.26 | 0.75 | Δ0.08 | ▼0.41 |

TABLE II

*Full size tunneling shot for middle-size section (14 inch boom used)

| item | method: present invention ① | burn-cut blasting method ② | V-cut blasting method ③ | comparison ①-② | comparison ①-③ |
|---|---|---|---|---|---|
| tunnel standard (m × m) | 8.0 × 7.5 | 8.0 × 7.5 | 8.0 × 7.5 | | |
| digging sectional area ($m^2$) | 53.13 | 53.13 | 53.13 | | |
| type of a rock | hard rock (granite) | hard rock (granite) | hard rock (granite) | | |
| (A) hole depth (m) | 3.7 | 3.7 | 3.7 | — | — |
| (B) advance (m) | 3.62 | 3.39 | 3.28 | Δ0.23 | Δ0.34 |
| blasting efficiency (B/A × 100) | 98 | 92 | 89 | Δ6 | Δ9 |
| drilling time (min.) | 120.9 | 166.1 | 117.3 | ▼45.2 | Δ3.6 |

TABLE II-continued

*Full size tunneling shot for middle-size section (14 inch boom used)

| item | | method: present invention ① | burn-cut blasting method ② | V-cut blasting method ③ | comparison ①-② | comparison ①-③ |
|---|---|---|---|---|---|---|
| number of holes | unloaded hole | — | 3 | — | ▼3 | — |
| | v hole | 6 | — | 6 | Δ6 | — |
| | others | 83.2 | 88.8 | 76 | ▼5.6 | Δ7.2 |
| | total | 89.2 | 91.8 | 82 | ▼2.6 | Δ7.2 |
| charge (KG) | | 180.9 | 237.8 | 184.3 | ▼56.9 | ▼3.4 |
| specific explosives quantity (KG/M$^3$) | | 0.94 | 1.32 | 1.06 | ▼0.38 | ▼0.12 |
| flying distance of muck (M) | | 44.0 | 90.4 | 49.3 | ▼46.4 | ▼5.3 |
| scaling time (min.) | | 34.7 | 61.1 | 80.9 | ▼26.4 | ▼46.2 |
| volume of the largest muck (M$^3$) | | 0.40 | 0.25 | 0.65 | Δ0.15 | ▼0.25 |

TABLE III

*Full size tunneling shot for large section (18 inch boom used)

| item | | method: present invention ① | burn-cut blasting method ② | V-cut blasting method ③ | comparison ①-② | comparison ①-③ |
|---|---|---|---|---|---|---|
| tunnel standard (m × m) | | 18 × 7.5 | 18 × 7.5 | 18 × 7.5 | | |
| digging sectional area (m$^2$) | | 111.442 | 111.442 | 111.442 | | |
| type of a rock | | hard rock (granite) | hard rock (granite) | hard rock (granite) | | |
| (A) hole depth (m) | | 4.85 | 4.85 | 4.85 | — | — |
| (B) advance (m) | | 4.77 | 4.47 | 4.35 | Δ0.3 | Δ0.42 |
| blasting efficiency (B/A × 100) | | 98 | 92 | 90 | Δ6 | Δ8 |
| drilling time (min.) | | 141.6 | 202.9 | 138.3 | ▼61.3 | Δ3.3 |
| number of holes | unloaded hole | — | 3 | — | ▼3 | — |
| | v hole | 8 | — | 8 | Δ8 | — |
| | others | 148 | 155 | 126 | ▼7 | Δ22 |
| | total | 156 | 158 | 134 | ▼2 | Δ22 |
| charge (KG) | | 457.9 | 567.6 | 465.1 | ▼109.7 | ▼7.2 |
| specific explosives quantity (KG/M$^3$) | | 0.86 | 1.14 | 0.96 | ▼0.28 | ▼0.10 |
| flying distance of muck (M) | | 46.2 | 87.3 | 52.2 | ▼41.1 | ▼6 |
| scaling time (min.) | | 48.8 | 87.9 | 123.6 | ▼39.1 | ▼74.8 |
| volume of the largest muck (M$^3$) | | 0.31 | 0.25 | 0.83 | Δ0.06 | ▼0.52 |

TABLE IV

*Full size tunneling shot for middle-size section (18 inch boom used)

| item | | method: present invention ① | burn-cut blasting method ② | V-cut blasting method ③ | comparison ①-② | comparison ①-③ |
|---|---|---|---|---|---|---|
| tunnel standard (m × m) | | 8.0 × 7.5 | 8.0 × 7.5 | 8.0 × 7.5 | | |
| digging sectional area ($m^2$) | | 111.442 | 111.442 | 111.442 | | |
| type of a rock | | hard rock (granite) | hard rock (granite) | hard rock (granite) | | |
| (A) hole depth (m) | | 4.85 | 4.85 | 4.85 | — | — |
| (B) advance (m) | | 4.76 | 4.47 | 4.32 | Δ0.29 | Δ0.44 |
| blasting efficiency (B/A × 100) | | 98 | 92 | 89 | Δ6 | Δ9 |
| drilling time (min.) | | 139.7 | 194.2 | 131.4 | ▼54.5 | Δ8.3 |
| number of holes | unloaded hole | — | 3 | — | ▼3 | — |
| | v hole | 6 | — | 6 | Δ6 | — |
| | others | 83 | 88 | 76 | ▼5 | Δ7 |
| | total | 89 | 91 | 82 | ▼2 | Δ7 |
| charge (KG) | | 230.4 | 308.5 | 240.7 | ▼78.1 | ▼10.3 |
| specific explosives quantity ($KG/M^3$) | | 0.91 | 1.30 | 1.05 | ▼0.39 | ▼0.14 |
| flying distance of muck (M) | | 44.3 | 93.6 | 57 | ▼49.3 | ▼12.7 |
| scaling time (min.) | | 43.6 | 66.6 | 97.2 | ▼23 | ▼53.6 |
| volume of the largest muck ($M^3$) | | 0.4 | 0.25 | 0.65 | Δ0.15 | ▼0.25 |

Various advantages of the present invention and an explanation of such advantages are outlined below.

(1) The drilling is accomplished easily and the drilling time is reduced.

(i) In a burn cut method, drilling must be done so that the spacing of pilot holes in the periphery of relief holes may be 5 to 7 cm. In an angle cut, the spacing at the bottom between the two holes that compose each V-hole must also be about 10 cm. Accordingly, the above blasting methods need a sophisticated level of drilling techniques and machines. On the other hand, according to the present invention, the spacing at the bottom between the two holes that compose each V-hole extends to 30–50 cm. Even in the case that the drilling degree of V holes is different from each other and/or V holes are not aligned in a straight line, the result of a test blasting reveals that the blasting efficiency is not reduced.

(ii) In an angle cut method, cut spreader holes must be tightly packed with explosives. So, in consideration of that, a number of holes are required. With the burn cut method, relief holes having a large diameter must be drilled. On the other hand, in the present invention the drilling time is reduced because the above relief holes are not required.

(2) Specific explosives quantity is low.

(i) According to the present invention, blasting is efficiently achieved even with a small quantity of explosives because the unloaded portions of a number of parallel cut holes surrounded by V-holes function as free surfaces.

(ii) The blasting of parallel cut holes beneath the bottom of V-holes is boosted by the blasting pressure in V-holes so that parallel cut holes beneath the bottom of V-holes are efficiently blasted. Accordingly, there will be few bootlegs after the blast.

(iii) The second free surface is formed by center cut holes in the shape of a cube. Therefore, the explosives quantity used in the blasting of peripheral holes is reduced.

(iv) The blasting efficiency is improved to the greatest level. Therefore, the explosives quantity used in excavation is less than used in methods in the prior art.

(3) The blasting efficiency is high.

(i) The center cut holes are completely dug out without a bootleg. Accordingly, the blasting efficiency is high.

(ii) The drilling work is easy and the blasting efficiency is not changed even in the case where interpenetration among the holes occurs.

(iii) Regardless of the drilling condition, the blast is efficiently achieved. Therefore, the blasting efficiency is not changed.

(4) The reinforcing work is easy because the damage zone of the working face and the peripheral rock is very small.

(i) Thanks to parallel holes, the depth of the hole bottoms is constant and the blasting pressure acts toward the direction of gravity. Accordingly, the damage zone of the working face is very small.

(ii) The damage zone of a peripheral rock is low because the blast is efficiently achieved under the condition where peripheral holes are not tightly loaded.

(iii) The blasting pressure is reduced because center cut holes are sequentially blasted with each other with the time difference being milliseconds or deciseconds. Accordingly, the vibration of blasting is remarkably reduced.

(iv) The secondary deformation is restrained because the damage zone in the peripheral rock is small. Therefore, the reinforcing work (rock bolting, shotcreting, concrete lining, etc.) is easy.

(5) The danger of accidents is prevented because the quantity of fragmented rocks is low.

(i) The quantity of fragmented rocks is low because the damage zone of the working face and the peripheral rock is small. Accordingly, the danger of a cave-in is reduced.

(ii) The scaling time (by human power or machines) is reduced because the quantity of fragmented rocks is low.

(iii) The blasting face in the working face is fine because the quantity of fragmented rocks is small and the overbreak is low.

(6) The flying distance of muck is short, so that damage to equipment is reduced. Also, mucks have a proper size, so they are easy to remove.

(i) The flying distance of muck is so short that a ventilation pipe can be installed near the working face. Accordingly, the working efficiency is improved because a ventilation after blasting is facilitated.

(ii) The work is efficiently performed because an airpipe, a drill's water pipe, and an electrical panel for the drilling and the reinforcing work can be installed near the working face. Also, the reinforcing work can be performed in a suitable time.

(iii) The muck can be easily removed because the flying distance of the muck is short and the rock is blasted in a suitable size according to the unloaded holes within V-holes.

(7) The working time per excavation cycle is reduced, therefore the cost of excavation can be reduced.

(i) The working time per excavation cycle is reduced because drilling time, removing time of muck, charging time, reinforcing time, and etc. are shortened.

(ii) The cost of excavation is lowered because the working time per excavation cycle, explosives cost, reinforcing cost, removing time of fragmented rock, and removing time of muck are reduced.

What is claimed is:

1. A method for drilling cut holes in a working face having one free surface comprising the steps of:

identifying a central zone of the working face;

drilling a plurality of V-holes at an angle either in a horizontal angle cut pattern or in a vertical angle cut pattern around the central zone of the working face thereby defining an area surrounded by said V-holes; and drilling a plurality of parallel cut holes within the area surrounded by said V-holes in the working face, wherein a spacing of said parallel cut holes is 20 to 30 cm in a central portion of the area surrounded by said V-holes in the working face and is 10 to 50 cm in other portions of said area.

2. A method for drilling cut holes in a working face having one free surface and for loading electric detonators therein, the method comprising the steps of:

drilling a number of V-holes at a predetermined angle either in a horizontal angle cut pattern or in a vertical angle cut pattern around a central zone of the working face;

drilling a number of parallel cut holes within an area surrounded by said said V-holes in the working face; and loading an electric detonator and an explosive material in the V-holes and the parallel cut holes, wherein the explosive material is loaded in said parallel cut holes from a bottom line of the parallel cut holes up to a bottom line of the V-holes by indirect priming.

3. A method in accordance with claim 2 wherein:

the explosive material is loaded in the V-holes by indirect priming or middle priming.

4. A method in accordance with claim 2 wherein:

the electric detonator loaded in the V-holes comprises a delay electric detonator or an instantaneous electric detonator.

5. A method in accordance with claim 2 wherein:

the electric detonator loaded in the parallel cut holes comprises a delay electric detonator or an instantaneous electric detonator.

6. A method for blasting cut holes in a working face having one free surface comprising steps of:

blasting V-holes in order to form a slanted free surface;

blasting center parallel cut holes in a central region of the slanted free surface in order to form a funnel-shaped free surface; and sequentially blasting middle parallel cut holes and outer parallel cut holes formed around the funnel-shaped free surface to form a cubical space.

7. A method in accordance with claim 6 wherein:

said center parallel cut holes, said middle parallel cut holes and said outer parallel cut holes are sequentially blasted with a difference in time ranging from milliseconds to deciseconds.

8. A method for excavating a working face comprising steps of:

drilling a number of V-holes at a predetermined angle either in a horizontal angle cut pattern or in a vertical angle cut pattern about a center zone of the working face, and drilling a number of parallel cut holes within an area surrounded by said V-holes in the working face, and drilling parallel cut spreader holes, stoping holes and contour holes in an area outside of the parallel cut holes;

loading an electric detonator in the V-holes and loading an explosive material by direct priming in the parallel cut hole up to the bottom of the slant holes and loading said cut spreader holes, stoping holes, and contour holes;

blasting the V-holes to form a slanted free surface;

blasting center cut holes of the parallel cut holes to form a funnel-shaped free surface;

sequentially blasting middle cut holes and outer cut holes of the parallel cut holes to form a cubical space; and sequentially blasting said cut spreader holes, stoping holes, and contour holes.

9. A method in accordance with claim 8 wherein:

said center cut holes, said middle cut holes, and said outer cut holes of the parallel cut holes are sequentially blasted with a difference in time on the order of milliseconds to deciseconds.

10. A method of excavating a specific area of a working face having one free surface according to excavation conditions, the method comprising steps of:

drilling a plurality slanted hole pairs at predetermined angles on the specific area the working face, bottoms of the slanted hole pairs being spaced apart at a bottom line of the slanted hole pairs;

drilling a plurality of parallel cut holes within a portion of the working face, including center parallel cut holes, having a bottom line which extends beyond the bottom line of the slanted hole pairs;

loading explosive materials in the slanted hole pairs; and loading explosive materials in the center parallel cut holes from the bottom line of the center parallel cut holes up to the bottom line of the slanted hole pairs.

11. The method of claim 10, wherein parallel cut holes are drilled adjacent the center parallel cut holes and are loaded from the bottom line of the parallel cut holes up to a boundary defined by the slanted hole pairs.

12. The method of claim 11, wherein the parallel cut holes are loaded with indirect priming.

13. The method of claim 12 further comprising the steps of:

blasting the slanted hole pairs;

thereafter blasting of the center parallel cut holes; and thereafter sequentially blasting parallel cut holes drilled immediately adjacent to the center cut holes to parallel cut holes drilled further away from the center parallel cut holes.

* * * * *